US006389831B1

(12) United States Patent
AN

(10) Patent No.: US 6,389,831 B1
(45) Date of Patent: May 21, 2002

(54) AIR CONDITIONER

(75) Inventor: Byong-Hwa AN, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/804,139

(22) Filed: Mar. 13, 2001

(30) Foreign Application Priority Data

Nov. 11, 2000 (KR) ..... 2000-67001

(51) Int. Cl.[7] ..... F25D 23/12
(52) U.S. Cl. ..... 62/262; 62/298
(58) Field of Search ..... 62/298, 262

(56) References Cited

U.S. PATENT DOCUMENTS 5,361,981 A * 11/1994 Albert et al. ..... 236/42
5,896,921 A * 4/1999 Lee ..... 165/149
6,009,717 A * 1/2000 Hernandez et al. ..... 62/262
6,182,460 B1 * 2/2001 Hernandez et al. ..... 62/262
6,260,371 B1 * 7/2001 Moraes et al. ..... 62/262
6,300,564 B1 * 10/2001 Moraes et al. ..... 174/52.1
6,301,914 B1 * 10/2001 Oliva et al. ..... 62/262
6,305,765 B1 * 10/2001 Park ..... 312/223.1
2001/0035021 A1 * 11/2001 Kang et al. ..... 62/262

FOREIGN PATENT DOCUMENTS

JP 06-002888 1/1994

* cited by examiner

*Primary Examiner*—William C. Doerrler
*Assistant Examiner*—Mark Shulman
(74) *Attorney, Agent, or Firm*—Robert E. Bushnell, Esq.

(57) ABSTRACT

Disclosed herein is an air conditioner that is capable of increasing its cooling capacity with its improved evaporator and control box. The air conditioner includes an indoor air inlet formed on an air conditioner body. An evaporator is disposed in the air conditioner body behind the indoor air inlet. A control box including various electric and electronic parts is situated in the indoor portion of the air conditioner body. The control box is positioned over the evaporator and the evaporator is extended relatively wide. The width of the evaporator may be substantially analogous to the width of the air conditioner body. The width of the indoor air inlet may be substantially analogous to the width of the evaporator. The condenser of the electric and electronic parts may be provided with terminals, the portion of the condenser including the terminals is preferably situated in the control box, and the remaining portion is downwardly projected from the control box.

15 Claims, 5 Drawing Sheets

AIR CONDITIONER

CLAIM OF PRIORITY

This application makes reference to, incorporates the same herein, and claims all benefits accruing under 35 U.S.C. §119 from an application for AIR CONDITIONER earlier filed in the Korean Industrial Property Office on Nov. 11, 2000 and there duly assigned Ser. No. 67001/2000 by that Office.

BACKGROUND OF THE INVENTION

1. Field of the Invention

The present invention relates generally to air conditioners, and more particularly to an air conditioner that is capable of increasing its cooling capacity with its improved evaporator and control box.

2. Description of the Prior Art

In a general window air conditioner, an indoor air inlet and an indoor air outlet are formed on the indoor side of the air conditioner to suck and exhaust indoor air, while an outdoor air inlet and an outdoor air outlet are formed on the outdoor side of the air conditioner to suck and exhaust outdoor air. An evaporator and an evaporator fan are mounted in the indoor portion of the air conditioner to cool and circulate indoor air, while a condenser and a condenser fan are mounted in the outdoor portion of the air conditioner to dissipate heat and circulate outdoor air. A motor is mounted in the space between the indoor and outdoor portions of the air conditioner to operate the evaporator and condenser fans, and a compressor is mounted in the same space to compress gaseous coolant to high-temperature and high-pressure coolant. A control box containing various electric and electronic parts for controlling the above-mentioned elements is mounted in the indoor portion of the air conditioner.

FIG. 1 is a perspective view of a conventional window air conditioner. An indoor air inlet 2*a* and an indoor air outlet 4 are formed on one side of the front of an air conditioner body 1. An evaporator 3 is situated behind the indoor air inlet 2a. A control box 5 including a function selection switch, a temperature adjustment switch and a capacitor 6 for a motor and a compressor is mounted beside the evaporator 3. The control box 5 is constructed to enclose various electrical and electronic parts so as to protect the parts from moisture. Generally, the control box 5 vertically extends long to accommodate an elongated capacitor.

In the conventional air conditioner, one side of the front of the conditioner body 1 is occupied by the control box 5, so there is only a small space for an evaporator, thereby restricting the evaporator to a relatively small size. Moreover, the evaporator is restricted to a relatively small size owing to the spatial restriction, so there is a limit to the increase of the cooling capacity of the air conditioner.

SUMMARY OF THE INVENTION

Accordingly, the present invention has been made keeping in mind the above problems occurring in the prior art, and an object of the present invention is to provide an air conditioner, which is capable of providing sufficient room for a relatively large evaporator while keeping its overall size constant, thereby increasing its cooling capacity.

In order to accomplish the above object, the present invention provides an air conditioner, comprising: an indoor air inlet formed on an air conditioner body; an evaporator disposed in the air conditioner body behind the indoor air inlet; and a control box including various electric and electronic parts, the control box being situated in the indoor portion of the air conditioner body; wherein the control box is positioned over the evaporator and the evaporator is extended relatively wide.

The width of the evaporator may be substantially analogous to the width of the air conditioner body.

The width of the indoor air inlet may be substantially analogous to the width of the evaporator.

A capacitor of the electric and electronic parts may be provided with terminals, the portion of the capacitor including the terminals is preferably situated in the control box, and the remaining portion of the capacitor is downwardly projected from the control box through an opening.

The control box may further comprise a support plate downwardly extended from the edge of the opening of the control box, and the capacitor is secured to the support plate by a band clamp.

As depicted in FIGS. 2 and 3, in an air conditioner of the present invention, an upper case 11, a base plate 12, a front panel 13 and a rear panel (not shown) constitute the exterior of an air conditioner body 10. In such a case, the front panel 13 of the conditioner body 10 is situated inside of a building, whereas the rear panel of the conditioner body 10 is situated outside of the building.

In addition, the present invention provides an air conditioner, comprising an indoor air inlet formed on an air conditioner body and an evaporator disposed in the air conditioner body behind the indoor air inlet, wherein the width of the evaporator is substantially analogous to the width of the air conditioner body.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
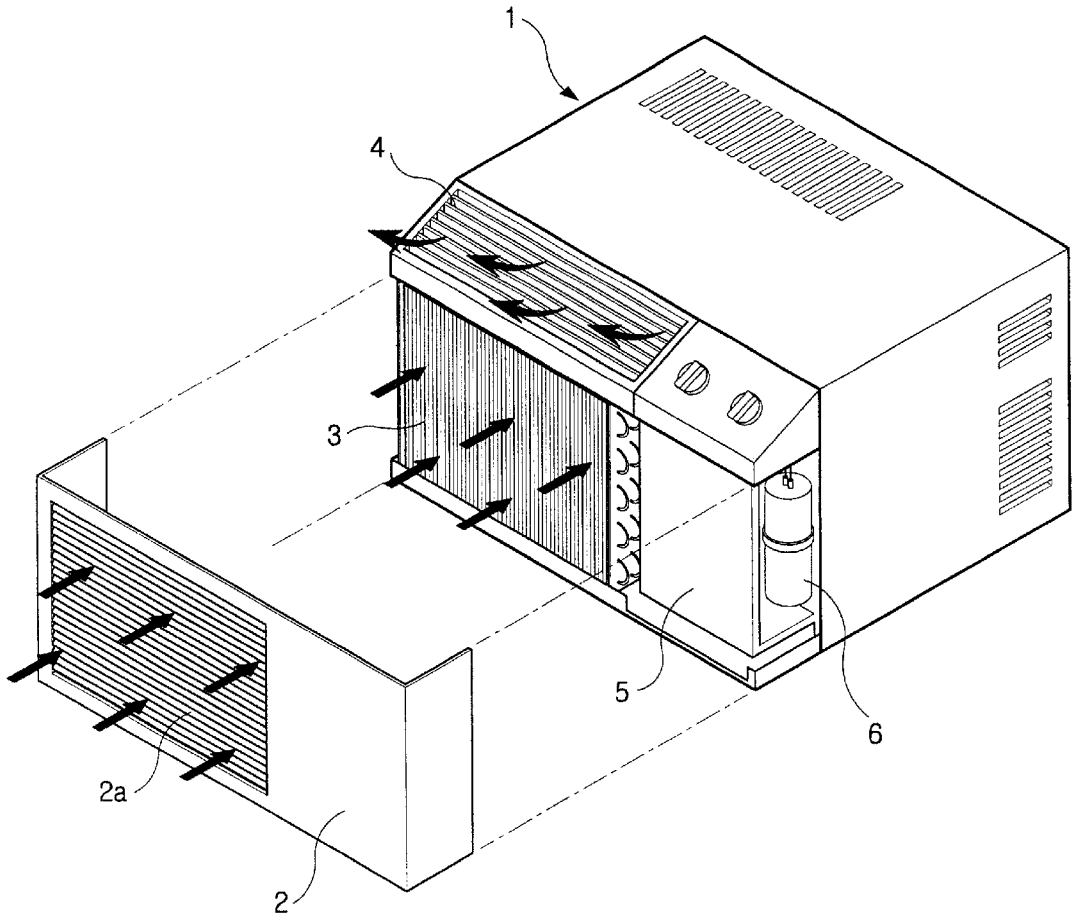
FIG. 1 (PRIOR ART)
FIG. 1 is a perspective view of a conventional window air conditioner.

Reference now should be made to the drawings, in which the same reference numerals are used throughout the different drawings to designate the same or similar components.

Figure 2:
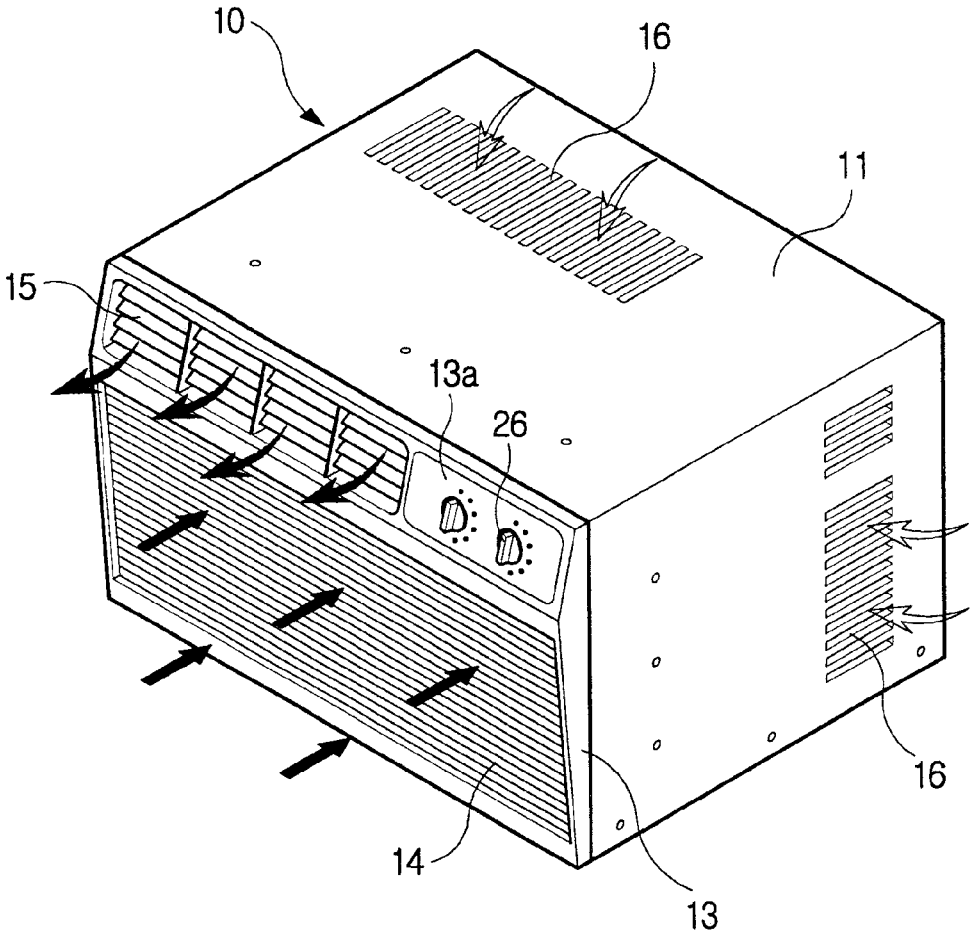
FIG. 2 is a perspective view of an air conditioner of the present invention.
Figure 3:
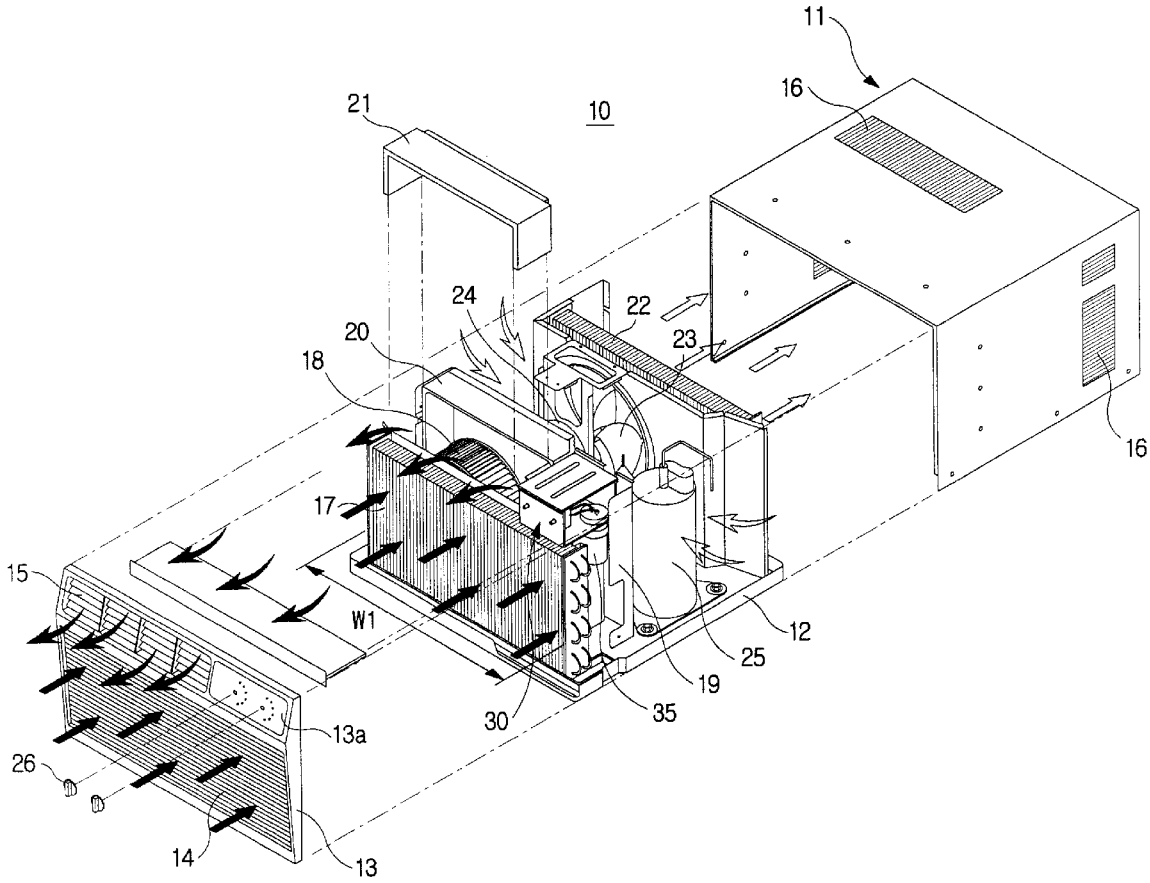
FIG. 3 is an exploded perspective view of the air conditioner of the present invention, showing the arrangement of the evaporator and control box of the air conditioner.

As depicted in FIGS. 2 and 3, in an air conditioner of the present invention, an upper case 11, a base plate 12, a front panel 13 and a rear panel (not shown) constitute the exterior of an air conditioner body 10. In such a case, the front panel 13 of the conditioner body 10 is situated inside of a building, whereas the rear panel of the conditioner body 10 is situated outside of the building.

An indoor air inlet 14 and an indoor air outlet 15 are formed on the front panel 13 to suck and exhaust indoor air, and outdoor air inlets 16 are formed on the top and sides of the upper case 11. Although not shown, an outdoor air outlet is formed on the rear panel of the conditioner body 10.

An evaporator 17 is situated in the conditioner body 10 while being inwardly spaced apart from the indoor air inlet 14 of the front panel 13, so as to cool indoor air. An evaporator fan 18 is placed behind the evaporator 17 to suck indoor air. A partition 19 is mounted behind the evaporator fan 18 to divide the interior space of the conditioner body 10 into an indoor portion and an outdoor portion. Two ducts 20 and 21 are positioned around and over the evaporator fan 18 to form an air passage to guide the indoor air sucked through the evaporator 17 toward the indoor air outlet 15.

A condenser 22 and a condenser fan 23 are mounted in the outdoor portion of the conditioner body 10 to dissipate heat to and circulate outdoor air. A motor 24 is mounted behind the partition 19 to drive the evaporator fan 18 and the condenser fan 23. A compressor 25 is mounted behind the partition 19 to compress gaseous coolant into high-temperature and high-pressure coolant. A control box 30 containing various electric and electronic parts is positioned behind the control section 13*a* of the front panel 13, on which adjusting knobs 26 are mounted, to start, stop and control the air conditioner.

In accordance with the present invention, while the overall size of the air conditioner is not increased, the size of the evaporator 17 can be increased, which can be achieved by a reduction in the size of the control box 30, thereby increasing the cooling capacity of the air conditioner.

To this end, the evaporator 17 situated behind the front panel 13 is extended wide to have a width W1 analogous to the width of the conditioner body 10, and the indoor air inlet 14 of the front panel 13 is extended to have a width and a height corresponding to the width and height of evaporator 17.

The control box 30 is miniaturized, so the control box 30 can be situated over the evaporator 17 beside the indoor air outlet 15. In the air conditioner of the present invention, the sum of the width of the indoor air outlet 15 and the width of the control box 30 is substantially analogous to the width W1 of the evaporator 17.

Figure 4:
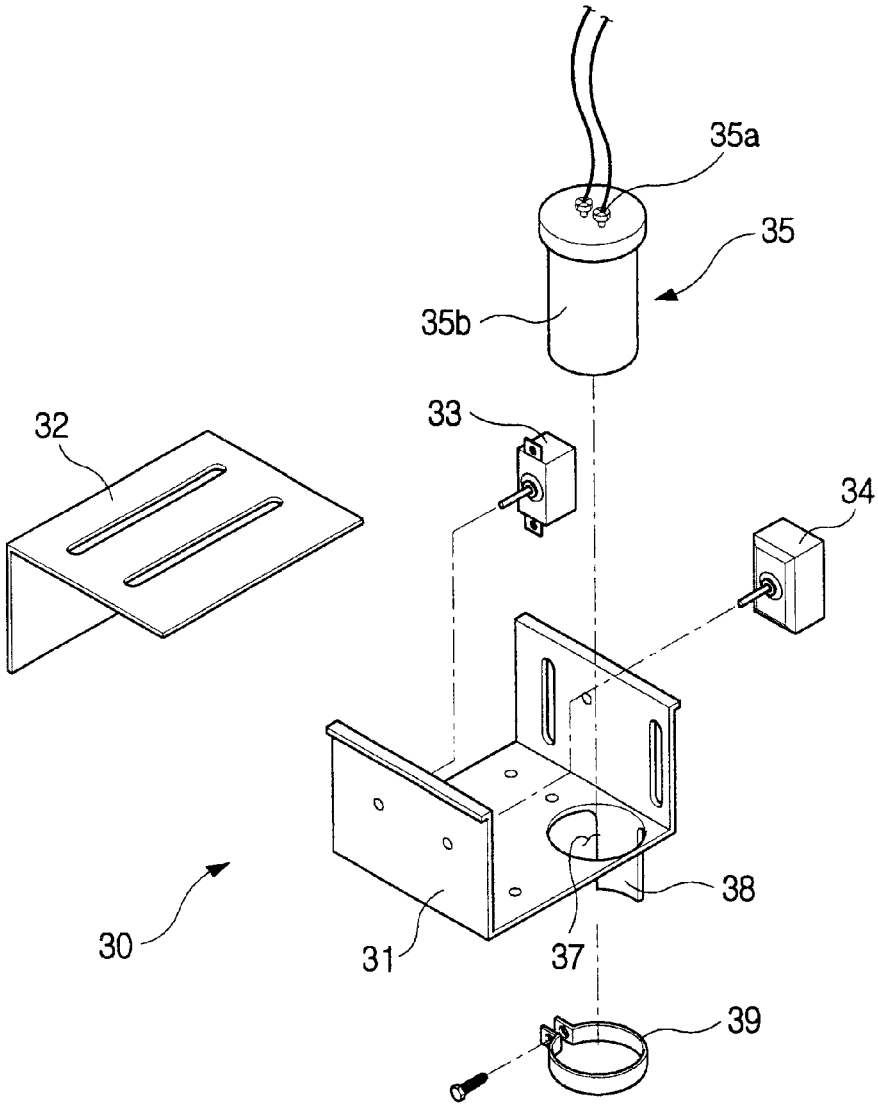
FIG. 4 is an exploded perspective view showing the control box of the air conditioner of the present invention.
Figure 5:
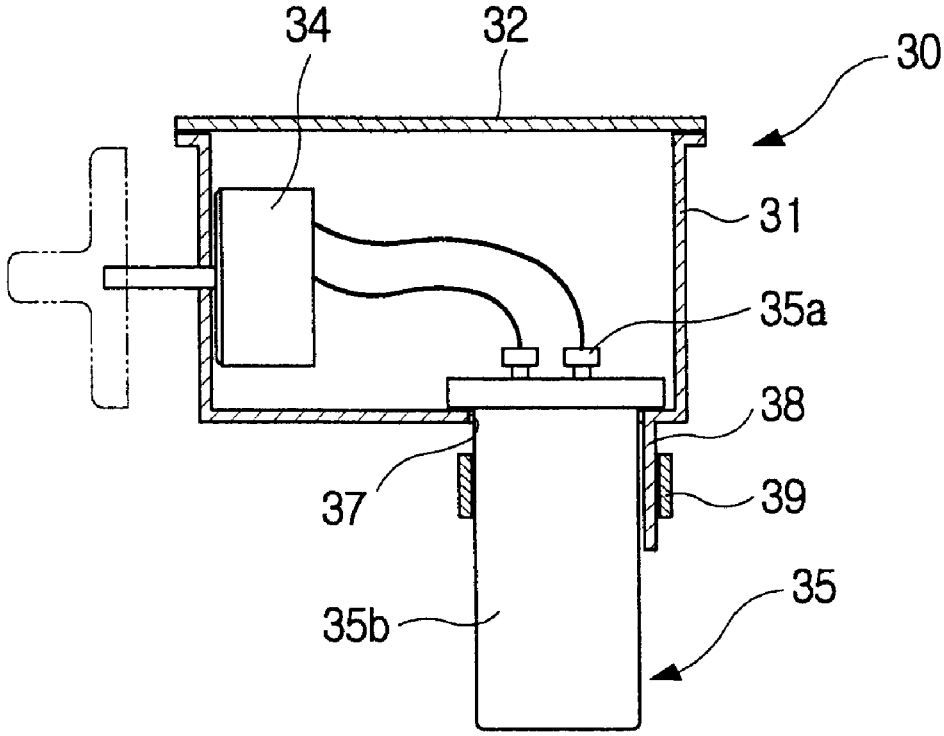
FIG. 5 is a partial cross section showing the assembled control box of the air conditioner of the present invention.

As indicated in FIGS. 4 and 5, the control box 30 is comprised of a lower cover 31 into which a front wall, a rear wall and a floor are integrated and an upper cover 32 into which a roof and a sidewall are integrated. A function selecting switch 33 and a temperature adjusting switch 34 are mounted in the lower cover 31 to be connected to the control knobs 26 that are mounted on the control section 13*a* of the front panel 13. A capacitor 35 is held by the floor of the lower cover 31 at its upper portion while penetrating the floor of the lower cover 31, so as to start the motor 24 and the compressor 25. In this case, the capacitor 35 is generally cylindrical, and is provided with electric terminals 35*a* to which an electric wire is connected. All the components of the capacitor 35 are enclosed by a casing 35*b* except the terminals 35*a*.

In seating the capacitor 35 on the control box 30, the portion of the capacitor 35 including the terminals 35*a* is preferably situated in the control box 30, while the remaining portion is downwardly projected from the control box 30 through an opening 37 formed on the floor of the lower cover 31. This construction protects the terminals 35*a* of the capacitor 35 to be insulated and minimizes the size of the control box 30, thereby allowing the control box 30 to be positioned over the evaporator.

A support plate 38 is downwardly extended from the edge of the opening 37 to allow the capacitor 35 to be secured thereto. A band clamp 39 secures the capacitor 35 to the support plate 38 by holding the capacitor 35 and the support plate 38 together.

Hereinafter, the operation of the air conditioner of the present invention is described.

When the compressor 25 is operated, coolant is circulated through the evaporator 17 and the condenser 22.

Meanwhile, when the motor 24 is operated, the evaporator fan 18 and the condenser fan 23 are operated to circulate indoor air and outdoor air. In more detail, the indoor air is sucked toward the evaporator 17 through the indoor air inlet 14 of the front panel 13, exchanges heat with the evaporator 17, and is exhausted to indoor space through the indoor air outlet 15. In this case, the width of the indoor air inlet 14 and the width W1 of the evaporator 17 each are substantially analogous to the width of the conditioner body 10, so a large amount of indoor air is sucked through the indoor air inlet 14 and the sucked indoor air is sufficiently cooled through heat exchange with the wide evaporator 17, thus improving the cooling capacity of the air conditioner. The outdoor air is sucked into the conditioner body 10 through the outdoor air inlets 16 formed on the top and sides of the upper case 11, cools the compressors 25 and the motor 24, exchanges heat with the condenser 22, and thereafter is exhausted to the outside.

As described above, the present invention provides an air conditioner, which is capable of providing sufficient room for a relatively large evaporator while keeping its overall size constant by miniaturizing its control box through an improvement in the structure of the control box, thereby increasing its cooling capacity.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner, comprising:

an indoor air inlet formed on an air conditioner body;

an evaporator disposed in said air conditioner body behind said indoor air inlet; and a control box including various electric and electronic parts, said control box being situated in an indoor portion of said air conditioner body and positioned over said evaporator; and a capacitor protruding from said control box, said capacitor having a terminal portion and a body portion coupled to said terminal portion, said terminal portion disposed within said control box while said body portion is disposed outside control box.

2. The air conditioner according to claim 1, wherein said evaporator has substantially the same width as said air conditioner body.

3. The air conditioner according to claim 1, wherein said indoor air inlet has substantially the same width as said evaporator.

4. The air conditioner according to claim 1, wherein said capacitor is provided with terminals formed on said terminal portion of said capacitor, said terminals disposed within said control box while said body portion disposed outside said control box is downwardly projected from said control box through an opening formed on said control box.

5. The air conditioner according to claim 4, further comprising a support plate disposed outside said control box and downwardly extended from an edge defining said opening of said control box, said main body of capacitor secured to said support plate by a band clamp.

6. An air conditioner, comprising:

an indoor air inlet and an indoor air outlet both formed on an air conditioner body; and an evaporator disposed in said air conditioner body behind said indoor air inlet;

a control box disposed beside said indoor air outlet and above said evaporator; and a capacitor having a terminal portion and a body portion coupled to said terminal portion, said body portion disposed outside said control box while said terminal portion is disposed within said control box to be coupled to electrical parts contained in said control box.

7. The air conditioner of claim 1, said control box comprising an upper cover and a lower cover coupled to said upper cover to form an internal space, said lower cover having a bottom plate and an opening formed on said bottom plate, said capacitor protruding from said bottom plate toward outside of said control box through said opening.

8. The air conditioner of claim 1, said control box having a bottom plate and an opening formed on said bottom plate, said capacitor protruding from said bottom plate toward outside of said control box through said opening.

9. The air conditioner of claim 1, said terminal portion being greater than said body portion in width so that said body portion protrudes from said control box while said terminal portion is disposed within said control box.

10. An air conditioner comprising:

a control box containing various electrical parts to control said air conditioner; and a capacitor having a body portion and a terminal portion extended from said body portion, said terminal portion disposed within said control box to be coupled to said electrical parts while said body portion is disposed outside said control box.

11. The air conditioner of claim 10, said capacitor including terminals formed on said terminal portion and coupled to said electrical parts, said terminals and said electrical parts disposed within said control box.

12. The air conditioner of claim 10, said control box having an opening formed on a side of said control box, said opening communicating with both an inside and an outside of said control box, said body portion of said capacity protruding from said side toward said outside through opening.

13. The air conditioner of claim 10, said control box having an opening formed on a side of aid control box, said opening being greater than said body portion and less than said terminal portion in width or diameter.

14. The air conditioner of claim 10, said control box having an opening formed on a side of said control box, said terminal portion of said capacitor contacting said side while said body portion protrudes from said side toward an outside of said control box through said opening.

15. The air conditioner of claim 10, said control box having an opening formed on a side of said control box, said control box having a support plate extended from an edge defining said opening, said body portion of said capacitor secured to said support plate while protruding from said control box.

* * * * *